US012117258B1

(12) United States Patent
Archer et al.

(10) Patent No.: US 12,117,258 B1
(45) Date of Patent: Oct. 15, 2024

(54) DEVICES, SYSTEMS, AND METHODS FOR TRANSITIONING BETWEEN LOCAL OR REMOTE OPERATING MODES AND A SAFETY MODE

(71) Applicant: Flex Force Enterprises Inc., Portland, OR (US)

(72) Inventors: Cynthia Louise Archer, Sherwood, OR (US); Jacob Ryan Sullivan, Portland, OR (US); John Holbrook Vance, II, Oakland, CA (US)

(73) Assignee: Flex Force Enterprises, LLC, Portland, OR (US)

( * ) Notice: Subject to any disclaimer, the term of this patent is extended or adjusted under 35 U.S.C. 154(b) by 129 days.

(21) Appl. No.: 18/079,750

(22) Filed: Dec. 12, 2022

Related U.S. Application Data

(63) Continuation-in-part of application No. 17/116,812, filed on Dec. 9, 2020, now Pat. No. 11,525,649, which is a continuation-in-part of application No. 16/930,205, filed on Jul. 15, 2020, now Pat. No. 10,890,407.

(51) Int. Cl.

| | |
|---|---|
| ***F41A 17/06*** | (2006.01) |
| ***F41A 23/24*** | (2006.01) |
| *F41A 19/59* | (2006.01) |
| *F41G 3/16* | (2006.01) |

(52) U.S. Cl.
CPC ..... *F41A 23/24* (2013.01); *F41A 17/06* (2013.01); *F41A 19/59* (2013.01); *F41G 3/165* (2013.01)

(58) Field of Classification Search
CPC ..... F41A 27/28; F41A 27/30; F41A 19/59; F41A 23/24; F41A 17/06; F41G 3/165
USPC ..... 89/41.01, 41.02, 41.05, 41.09, 41.11
See application file for complete search history.

(56) References Cited

U.S. PATENT DOCUMENTS

| | | | | |
|---|---|---|---|---|
| 5,005,307 A * | 4/1991 | Horne | F41A 9/62 | 42/1.02 |
| 5,379,676 A * | 1/1995 | Profeta | F41G 3/02 | 89/41.06 |
| 5,949,015 A * | 9/1999 | Smith | F41G 3/22 | 89/41.09 |
| 6,769,347 B1 * | 8/2004 | Quinn | F41G 3/06 | 89/41.09 |
| 7,036,639 B2 * | 5/2006 | Exely | F41H 5/26 | 188/137 |

(Continued)

*Primary Examiner* — Jonathan C Weber
(74) *Attorney, Agent, or Firm* — The Law Office of Raul D. Martinez, PC

(57) ABSTRACT

Several examples of a dual remote control and crew-served weapon station are described herein that uniquely provide different operating modes, any one of which can be quickly and efficiently selected based on outputs from various system sensors (e.g., switches and buttons). For example, the weapon station may operate in a mode in which the weapon is remotely steered and fired (e.g., remote controlled). The weapon station may also operate in different modes in which the weapon is aimed and fired by a local operator (e.g., crew-served stabilized or full manual). The weapon station may also operate in a safety mode, which is selected when no operator is sensed by a local operator sensor and/or a remote operator sensor. In some examples, the safety mode includes utilizing safety equipment to lock the pointing direction of the weapon and secure the weapon from firing.

21 Claims, 10 Drawing Sheets

(56) References Cited

U.S. PATENT DOCUMENTS 7,231,862 B1 * 6/2007 Quinn ..... F41G 3/06 89/205
7,455,007 B2 * 11/2008 Quinn ..... F41G 3/06 89/41.18
7,493,846 B2 * 2/2009 Quinn ..... F41G 3/16 89/205
7,600,462 B2 * 10/2009 Quinn ..... F41G 3/06 89/41.09
7,614,333 B2 * 11/2009 Quinn ..... F41A 19/01 42/1.03
7,690,291 B2 * 4/2010 Quinn ..... F41G 3/06 89/41.14
7,802,391 B2 * 9/2010 Quinn ..... F41A 19/01 42/1.03
7,921,761 B1 * 4/2011 Quinn ..... F41G 3/06 89/204
7,921,762 B1 * 4/2011 Quinn ..... F41G 3/16 89/204
7,946,212 B1 * 5/2011 Quinn ..... F41G 3/16 89/204
7,946,213 B2 * 5/2011 Quinn ..... F41G 3/06 89/204
8,322,269 B2 * 12/2012 Sullivan ..... F41A 27/14 89/41.11
8,833,232 B1 * 9/2014 Fox ..... F41G 3/165 89/41.14
8,978,539 B2 * 3/2015 Teetzel ..... F41G 3/165 89/41.17
9,032,859 B2 * 5/2015 Fox ..... F41G 3/165 89/41.19
9,121,670 B2 * 9/2015 Fox ..... F41G 3/165
9,523,548 B2 * 12/2016 Fox ..... F41A 23/24
9,644,916 B2 * 5/2017 Hobson ..... F41A 27/18
10,371,479 B2 * 8/2019 Hobson ..... F41A 27/30
10,890,407 B1 * 1/2021 Archer ..... F41G 5/14
2004/0050240 A1 * 3/2004 Greene ..... F41A 23/24 89/41.06
2004/0134340 A1 * 7/2004 Quinn ..... F41G 3/06 89/41.01
2005/0263000 A1 * 12/2005 Hill ..... F41A 27/30 89/136
2008/0034954 A1 * 2/2008 Grober ..... F41G 5/14 89/41.02
2008/0048033 A1 * 2/2008 Quinn ..... F41G 3/16 89/41.17
2008/0110327 A1 * 5/2008 Quinn ..... F41A 27/28 89/41.02
2008/0110328 A1 * 5/2008 Quinn ..... F41G 3/06 89/200
2008/0110986 A1 * 5/2008 Quinn ..... F41G 3/06 235/411
2009/0139393 A1 * 6/2009 Quinn ..... F41G 3/06 89/41.18
2010/0011943 A1 * 1/2010 Quinn ..... F41A 19/01 89/1.1
2010/0275768 A1 * 11/2010 Quinn ..... F41G 3/16 235/404
2011/0042459 A1 * 2/2011 Sullivan ..... F41G 5/06 235/407
2012/0247317 A1 * 10/2012 Karakookly ..... F41A 27/28 89/127
2014/0283675 A1 * 9/2014 Fox ..... F41G 3/06 89/41.02
2015/0041538 A1 * 2/2015 Teetzel ..... F41G 3/06 235/404
2015/0059567 A1 * 3/2015 Fox ..... F41G 3/10 89/41.19
2015/0153128 A1 * 6/2015 Fox ..... F41G 3/22 89/41.01
2015/0267989 A1 * 9/2015 Hobson ..... F41A 27/30 89/37.12
2016/0047618 A1 * 2/2016 Fox ..... F41G 3/22 89/41.02
2016/0069629 A1 * 3/2016 Seckman ..... F41A 9/62 42/1.01
2016/0258704 A1 * 9/2016 Hobson ..... F41A 27/28
2019/0137219 A1 * 5/2019 Bockmon ..... F41G 5/16
2020/0018565 A1 * 1/2020 Hotz ..... F41A 27/24

* cited by examiner

DEVICES, SYSTEMS, AND METHODS FOR TRANSITIONING BETWEEN LOCAL OR REMOTE OPERATING MODES AND A SAFETY MODE

CLAIM OF PRIORITY

The present application is a continuation-in-part of and claims priority to U.S. patent application Ser. No. 17/116,812, entitled "WEAPON PLATFORM OPERABLE IN REMOTE CONTROL AND CREW-SERVED OPERATING MODES" and filed Dec. 9, 2020, which is a continuation of and claims priority to U.S. patent application Ser. No. 16/930,205, entitled "DUAL REMOTE CONTROL AND CREW-SERVED WEAPON STATION" and filed Jul. 15, 2020, both of which are assigned to the assignee hereof and hereby expressly incorporated by reference in their entirety.

FIELD

The subject matter described herein relates to weapon platforms and more particularly to weapon platforms that can be controlled both locally and remotely.

BACKGROUND

A weapon platform is generally any structure or system on which a weapon can be mounted. For example, a fighter jet is a weapon platform for missiles, bombs, or autocannons. Other vehicles, such as the Humvee, are considered weapon platforms as well, such as for grenade launchers, machine guns, and some missile launchers. Thus, the term "weapon platform" can describe an aircraft, a vehicle, a naval vessel, or an actual firearm system. In more general use, a weapon platform could be structured around a gun, such as a gun turret on a ship, or bracing on an aircraft.

SUMMARY

Several examples of a dual remote control and crew-served weapon station are described herein that uniquely provide different operating modes, any one of which can be quickly and efficiently selected based on outputs from various system sensors (e.g., switches and buttons). For example, the weapon station may operate in a mode in which the weapon is remotely steered and fired (e.g., remote controlled). The weapon station may also operate in different modes in which the weapon is aimed and fired by a local operator (e.g., crew-served stabilized or full manual). The weapon station may also operate in a safety mode, which is selected when no operator is sensed by a local operator sensor and/or a remote operator sensor. In some examples, the safety mode includes utilizing safety equipment to lock the pointing direction of the weapon and secure the weapon from firing.

In one example, a weapon platform comprises a cradle having a shape and size configured to receive and secure a weapon, a gimbal which, when active, stabilizes the cradle by selectively controlling pan and tilt angles of the cradle, and a controller. The controller is configured to cause a weapon mounted in the cradle to operate in (i) a first operating mode in which the weapon is remotely steered and fired, (ii) a second operating mode in which the cradle is stabilized by the gimbal and the weapon is aimed and fired by a local operator, and (iii) a third operating mode in which the cradle is manually steered and the weapon is fired by the local operator.

In some examples, the first operating mode is a stabilized operating mode. In other examples, the first operating mode is a non-stabilized operating mode.

In some examples, the local operator aims the weapon via a joystick located on a grip of the weapon.

In some examples, the second operating mode permits the local operator to manually manipulate the weapon.

In some examples, the controller is further configured to switch between a current operating mode and another operating mode in less than five seconds. In further examples, the controller is further configured to switch between the current operating mode and another operating mode in less than one second.

In some examples, the weapon platform further comprises a first trigger mechanism configured to remotely cause the weapon mounted in the cradle to fire in the first operating mode, and a second trigger mechanism configured to locally cause the weapon mounted in the cradle to fire in either the second operating mode or the third operating mode. In some examples, the first trigger mechanism and the second trigger mechanism do not interfere with each other in either the first, second, or third operating modes.

In some examples, the first trigger mechanism comprises a solenoid coupled to an internal trigger of the weapon mounted in the cradle, the solenoid configured to activate the internal trigger from a side of the weapon mounted in the cradle, in response to a control signal from a remote control station, and the second trigger mechanism comprises an external trigger coupled to the internal trigger of the weapon mounted in the cradle, the external trigger configured to activate the internal trigger from a rear portion of the weapon mounted in the cradle, in response to the operator locally applying physical force to the external trigger.

In other examples, the first trigger mechanism comprises a solenoid coupled to a mechanical linkage coupled to an internal trigger of the weapon mounted in the cradle, the solenoid configured to activate the internal trigger via the mechanical linkage, in response to a control signal from a remote control station, and the second trigger mechanism comprises an external trigger coupled to the mechanical linkage coupled to the internal trigger of the weapon mounted in the cradle, the external trigger configured to activate the internal trigger via the mechanical linkage, in response to the operator locally applying physical force to the external trigger.

In some examples, the weapon platform further comprises a first charging mechanism configured to remotely cause the weapon mounted in the cradle to charge in the first operating mode, and a second charging mechanism configured to locally cause the weapon mounted in the cradle to charge in either the second operating mode or the third operating mode. In some examples, the first charging mechanism and the second charging mechanism do not interfere with each other in either the first, second, or third operating modes.

In some examples, the first charging mechanism comprises an electrically activated actuator mechanically coupled to a bolt assembly of the weapon mounted in the cradle, the electrically activated actuator configured to cause the bolt assembly of the weapon to move in a manner to charge the weapon, in response to a control signal from a remote control station, and the second charging mechanism comprises a charging handle coupled to the bolt assembly of the weapon, the charging handle configured to charge the weapon, in response to the operator locally applying physical force to the charging handle.

In other examples, the first charging mechanism comprises an actuator coupled, via a cable and pulley system, to a sled that is resiliently biased towards a front end of the weapon, the actuator configured to pull the cable such that the sled pushes a charging handle coupled to a bolt assembly of the weapon mounted in the cradle to charge the weapon, in response to a control signal from a remote control station, and the second charging mechanism comprises the charging handle coupled to the bolt assembly of the weapon, the charging handle configured to charge the weapon, in response to the operator locally applying physical force to the charging handle.

In some examples, the weapon platform further comprises a communications interface to communicate with a remote control station that is configured to remotely operate the weapon mounted in the cradle in the first operating mode. In some examples, the weapon platform further comprises the remote control station, which comprises an electronic visual display; a remote operator sensor configured to sense whether an operator is remotely controlling, via the remote control station, at least one of the following: the weapon platform, and the weapon mounted in the cradle; a steering input control device configured to be used by a remote operator to remotely control the pan and tilt angles of the cradle in the first operating mode; a charging input control device configured to be used by the remote operator to remotely charge the weapon mounted in the cradle in the first operating mode; and a firing input control device configured to be used by the remote operator to remotely cause the weapon mounted in the cradle to fire in the first operating mode.

In some examples, the weapon platform further comprises a local operator sensor configured to sense whether an operator is locally controlling the weapon mounted in the cradle. In some examples, the local operator sensor is located on a local grip of the weapon mounted in the cradle and is configured to detect local application of physical force by the operator.

In some examples, the controller is further configured to prevent simultaneous operation of the weapon mounted in the cradle in both the first operating mode and the second operating mode. In some examples, the controller is further configured to determine a geographical location of a current aimpoint of the weapon and cause the gimbal to maintain the weapon mounted in the cradle aimed at the determined geographical location.

In some examples, the weapon platform further comprises a fired round sensor configured to sense when a round has been fired from the weapon mounted in the cradle, wherein the controller is further configured to monitor output from the fired round sensor to determine how many rounds have been fired from the weapon mounted in the cradle. In some examples, the weapon platform further comprises an electronic visual display configured to display at least one of the following values determined by the controller: a number of rounds that have been fired, and a number of rounds remaining.

In another example, a system comprises a first weapon platform comprising a cradle having a shape and size configured to receive and secure a first weapon, and a gimbal which, when active, stabilizes the cradle by selectively controlling pan and tilt angles of the cradle. The system further comprises a local operator sensor configured to sense whether an operator is locally controlling the first weapon mounted in the cradle, and a controller configured to cause the first weapon mounted in the cradle to operate in a first operating mode in which the first weapon is remotely steered and fired, and in response to the local operator sensor sensing that the operator is locally controlling the first weapon mounted in the cradle, cause the first weapon mounted in the cradle to selectively operate in either a second operating mode in which the cradle is stabilized by the gimbal and the first weapon is aimed and fired by the local operator, and a third operating mode in which the cradle is manually steered and the first weapon is fired by the local operator. The system additionally comprises a remote control station configured to remotely operate the first weapon mounted in the cradle in the first operating mode.

In some examples, the system further comprises a first trigger mechanism configured to remotely cause the first weapon mounted in the cradle to fire in the first operating mode, and a second trigger mechanism configured to locally cause the first weapon mounted in the cradle to fire in either the second operating mode or the third operating mode.

In some examples, the system further comprises a first charging mechanism configured to remotely cause the first weapon mounted in the cradle to charge in the first operating mode, and a second charging mechanism configured to locally cause the first weapon mounted in the cradle to charge in either the second operating mode or the third operating mode.

In some examples, the controller is further configured to prevent simultaneous operation of the first weapon mounted in the cradle in both the first operating mode and the second operating mode.

In some examples, the remote control station is configured to simultaneously remotely operate the first weapon platform, the first weapon, a second weapon platform, and a second weapon attached to the second weapon platform.

In a further example, a method comprises initiating operation of a weapon platform in a first operating mode. The weapon platform comprising a cradle having a shape and size configured to receive and secure a weapon, and a gimbal which, when active, stabilizes the cradle by selectively controlling pan and tilt angles of the cradle, a local operator sensor configured to sense whether an operator is locally controlling the weapon mounted in the cradle, and a controller configured to cause the weapon mounted in the cradle to operate in the first operating mode in which the weapon is remotely steered and fired, and in response to the local operator sensor sensing that the operator is locally controlling the weapon mounted in the cradle, cause the weapon mounted in the cradle to selectively operate in either a second operating mode in which the cradle is stabilized by the gimbal and the weapon is aimed and fired by the local operator, and a third operating mode in which the cradle is manually steered and the weapon is fired by the local operator. The method further comprises manually controlling, by the local operator, the weapon mounted in the cradle, and operating the weapon locally after the controller switches from the first operating mode to either the second operating mode or the third operating mode.

In some examples, the method further comprises ceasing manual control of the weapon, and resuming operation of the weapon mounted in the cradle in the first operating mode.

DETAILED DESCRIPTION

Figure 1A:
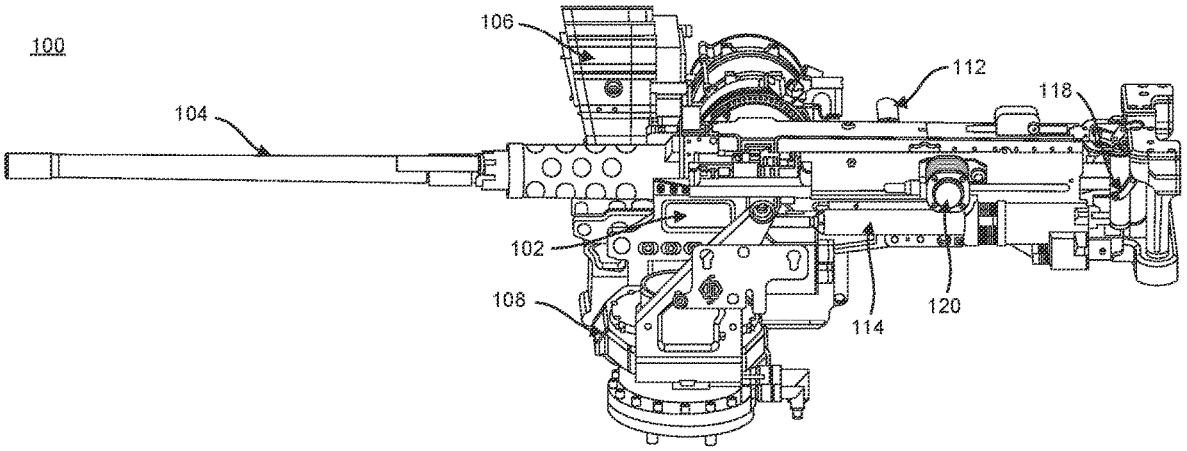
FIG. 1A is a side-view schematic illustration of an example weapon platform and a weapon attached thereto, both of which can be controlled locally and remotely.

Light and medium class weapons are typically fired from weapon mounts that are themselves attached to a platform. Examples of light class weapons include the M2HB 0.50 caliber machine gun and the MK19 40 mm automatic grenade launcher. Examples of medium class weapons include a variety of 40×53 mm automatic grenade launchers, 25 mm chain guns, and 30×173 mm rapid-fire cannons.

Examples of weapon mounts include crew-served weapon mounts such as rotorcraft door gunners and maritime weapon mounts, crew-served tripod mounts commonly used by dismounted soldiers, and a wide variety of fixed, flexible, and other moveable vehicle weapon mounts. In addition to crew-served weapon mounts, weapon mounts may also be remote controlled. Examples of remote controlled weapon stations include the Common Remotely Operated Weapon Station (CROWS) and the Mini-Typhoon designated by the U.S. Navy as the Remote Operated Small Arms Mount (ROSAM). Examples of platforms include riverine craft such as the Combatant Craft Medium (CCM) and the Special Operations Craft—Riverine (SOC-R), surface warfare craft such as the Littoral Combat Ship (LCS), infantry fighting vehicles such as the M2 Bradley, multipurpose vehicles such as the High Mobility Multipurpose Wheeled Vehicle (HMMWV), main battle tanks such as the M1A2 Abrams, and rotorcraft such as the UH-1 Huey and UH-60 Blackhawk.

Conventional crew-served weapon mounts suffer from systematic inaccuracies, as well as motion-induced, target tracking, and operator-specific inaccuracies. Stabilization subsystem architectures, with built-in processing and control, can effectively eliminate the largest inaccuracies in a compact and cost-effective manner. Conventional mechanical stabilization is used on systems such as the Mk49 (ROSAM) and Mk50 (Protector) remote weapon systems used by the United States Navy. Both of these systems use gyroscopes to measure the motion of the host platform and command a mechanical drive train to counteract the measured motion so that the weapon maintains the same aiming vector. Both of these systems also have an auxiliary mode of operation, wherein operators can mechanically disengage the drive train so that they can manually slew and fire the weapon. However, these conventional systems do not allow the operator to switch from manual aiming to stabilized mode without physically disengaging the drive train nor do they allow an operator to locally adjust or "fine tune" an existing aim point at the weapon once stabilization is underway.

Despite the drawbacks of conventional crew-served weapon mounts, the use of snipers, ambushes, sneak attacks, and guerrilla tactics by non-state actors and ununiformed combatants has increased in recent years, which requires our troops to transition between combat, peacekeeping, and law enforcement activities in and around areas with populations of uninvolved civilians and non-combatants. When functioning in a combat role, traditional crew-served weapon mounts enable high situational awareness and high slew rates to reposition the weapon and engage multiple targets or provide suppressive fire. However, traditional crew-served weapon mounts also enable a strong sociological advantage to having personnel visible to the civilian populace. This visibility casts our troops in the role of peace-keepers, rather than aggressors. In response, military and law enforcement leaders have emphasized the use of locally manned platforms to increase the visibility and peacekeeping effectiveness of the operator. Because of these operational goals and the heightened value of situational awareness and tactical flexibility, crew-served weapon mounts continue to serve our warfighters in the modern battlefield.

Remote weapon systems (RWS) are an alternate to crew-served mounts, especially in battlefield conditions. To be effective, a remote weapon system must provide the same capabilities as a crew-served weapon (e.g., the ability to aim, charge, and fire the weapon). To provide these capabilities, the RWS consists of three principal components, a gimbaled platform, an optical system, and a remote control station.

The weapon platform has a two-axis gimbal that is driven by electrically controlled motors and steered by the operator, typically using a joystick at the remote control station. With motion sensors and motor control, the gimbaled platform can also provide stabilization.

The optical system typically consists of one or more video cameras that provide live imagery to the remote control station. The purpose of the optical system is to give the operator both situational awareness and target identification and engagement capability. The optical system frequently includes a range measurement device, such as a laser range finder, to give the operator the ability to measure range to target.

The remote control station can be located in a protected location, typically inside the vehicle. The remote control station further provides a method to display the live video feed and includes the controls needed for an operator to steer the gimbal, as well as to fire and optionally charge the weapon.

Remote turreted or gimbaled weapon mounts, commonly used on ground vehicles by U.S. and allied forces, cover a range of armaments from personal small arms through heavy cannon. These systems have limited capability for crew to physically operate the weapon mount, as stabilization benefits are provided only during remote operation. Even when crew operation is permitted, there is no ready availability of a true free-gunning mode, as the weapons have significant mechanical resistance due to gear trains and/or other coupled drive train elements. These must either be overcome physically by the operator or be disabled with a specific mechanical procedure. The disable procedure requires time, training, and often risk to crew, who move to an exposed position to perform the mechanical procedure to disengage the gear train and/or drive train, which provide the benefits of weapon stabilization.

Moreover, conventional RWS are only intended for operation in defilade (e.g., a position offering protection from attack), causing the loss of both situational awareness and the sociological advantage of visible personnel. Despite the drawbacks of conventional remote weapon systems, RWS operators have the ability to acquire and engage targets while inside a vehicle, protected by its armor, which advantageously provides better force protection when the current situation dictates a transition from a peace-keeping role to a combat role.

A new approach is needed that integrates remote and crew-served operation through the use of appropriate activation/deactivation mechanisms (e.g., that do not require a mechanical procedure to disengage the stabilization mechanism) and an integrated control structure. The ideal weapon configuration for warfighters deployed in volatile situations would allow for seamless and fast transitions from a crew-served operating mode to a remotely controlled operating mode. The use of snipers, ambushes, sneak attacks, and guerrilla tactics can result in sudden changes of situational conditions.

A flexible RWS system would allow for more effective crew-served operation in peace-keeping, law enforcement, or combat activities where situational awareness and visibility are more important than defilade, and at the same time, it would give the operator the option to retreat to defilade for protection when traditional combat conditions arise. The realities of modern peace-keeping and policing missions motivated our development of the dual remote control and crew-served weapon stations (e.g., platforms) described herein.

The examples discussed below are generally directed to a dual remote control and crew-served weapon station, which is a unique implementation of the remote weapon station concept. As with all modern weapon stations, this weapon station provides the capability to aim and fire a weapon remotely from defilade (e.g., a position offering protection from attack). The dual remote control and crew-served weapon stations (e.g., platforms) described herein are stabilized platforms with active motion sensors and adaptive motor control to give an operator the ability to switch smoothly between the two crew-served operating modes (e.g., a local operator at the weapon) and a remote control operating mode (e.g., a remote operator utilizing a remote control station mounted inside a vehicle and/or under armor) during active operation.

The examples described herein include several components that work together to provide smooth, real-time transitions between remote and local control. For example, the base weapon mount (e.g., platform) includes three key subcomponents: the base, the weapon cradle, and the operator grips. The base houses all the electronics and drivetrain for the weapon gimbal. The drivetrain consists of a two-axis gimbal, which controls the weapon's pan and tilt angles. Encoders are mounted with each drive to provide accurate measurements of the weapon's pan and tilt angles. In addition, a three-axis gyroscope is mounted in the base. This gyroscope measures the angular velocity in yaw, pitch, and roll induced by platform motion and any flexing in the structure caused by weapon fire. To stabilize the weapon, the processor embedded in the base computes the pan and tilt angle necessary to correct the weapon's aimpoint. The weapon cradle is highly configurable to support different weapon types. The grip options for the crew-served weapon depend on the trigger group and backplate configuration of the weapon.

One particular example of the weapon platform includes a cradle, a gimbal, and a controller. The cradle has a shape and size configured to receive and secure a weapon. As described above, the gimbal stabilizes the cradle by selectively controlling pan and tilt angles of the cradle. More specifically, the gimbal utilizes motors to steer and stabilize the weapon attached to the weapon platform. The controller is configured to cause the weapon mounted in the cradle to selectively operate in one of several different operating modes, which will be discussed more fully below. In some examples, the weapon platform further includes an optical system, which delivers real-time imagery to a remote control station.

Unlike conventional weapon stations, the examples described herein uniquely provide different operating modes, any one of which can be quickly and efficiently selected without requiring any physical modification, manipulation, or mechanical change in the configuration of the weapon platform to switch between the operating modes. For example, a first operating mode is a mode in which the weapon is remotely steered and fired (e.g., remote controlled). A second operating mode is a mode in which the cradle is stabilized by the gimbal and the weapon is aimed and fired by a local operator (e.g., crew-served stabilized). A third operating mode is a mode in which the cradle is manually steered and the weapon is fired by the local operator (e.g., full manual). Some examples include a fourth operating mode (e.g., safety mode) in which the pointing direction of the weapon is locked and the weapon is secured (e.g., prevented) from firing.

One of the drawbacks of systems that require physical modification, manipulation, or mechanical change in the configuration (e.g., operational mode) of the weapon platform is that an operator performing such modification/manipulation may be under duress (e.g., while being fired upon by enemies), degrading the motor skills required by the operator to effectively and quickly make the required modification/manipulation. Thus, in some cases, the operator may be unable to complete the modification/manipulation required to switch operational modes. In other cases, the required modification/manipulation may take an undesirably long period of time to complete. One of the advantages of the examples described herein is that the controller is configured to switch between a current operating mode and another operating mode in less than five seconds. In still further examples, the controller is configured to switch between a current operating mode and another operating mode in less than one second.

In the examples described herein, the weapon can be aimed and fired locally from the crew-served position or remotely via a compatible remote control station. However, it is not necessary for the weapon platform to be connected continually, or even intermittently, to a remote control station. In some examples, the weapon may also be remotely charged via a remote control station.

The controller of the weapon platform is configured to allow manual operation of the weapon platform/weapon in response to control signals indicating that an operator is locally controlling the weapon platform/weapon. In some examples, the controller of the weapon platform is further configured to allow the weapon platform/weapon to be remotely controlled in response to (1) the absence of control signals indicating that an operator is locally controlling the weapon platform/weapon, and/or (2) the presence of control signals indicating that an operator is remotely controlling the weapon platform/weapon. Thus, no physical modification of the weapon platform is required to switch between operating modes. On the contrary, the weapon platforms described herein change between operating modes based on output from various sensors, buttons, switches, and the like.

As used herein, the term "local" refers to an entity (e.g., local operator) or activity located or performed at, on, or near the weapon platform or the weapon attached to the weapon platform. The term "remote" refers to an entity (e.g., remote operator) or activity located or performed at or on a remote control station configured to control the weapon platform and/or the weapon attached to the weapon platform. Thus, even if the entity or activity is located or performed at or on a remote control station that is near the weapon platform or the weapon attached to the weapon platform, such an entity or activity would be considered "remote" for the purposes of the examples described herein.

The dual remote control and crew-served weapon stations described herein enable remote control of a weapon platform and a weapon attached to the weapon platform without negatively impacting crew-served operation. One example of the dual remote control and crew-served weapon station is designed for the M2 machine gun, as illustrated in FIGS. 1A-1C and 3-4. The M2 machine gun shown in FIGS. 1A-1C and 3-4 includes compatible mechanisms for charging and firing the weapon both remotely and locally. Other examples are shown in connection with the M240 machine gun, as illustrated in FIGS. 2A-2B and 5-6. The M240 machine gun shown in FIGS. 2A-2B and 5-6 includes compatible mechanisms for charging and firing the weapon both remotely and locally. Of course, it is contemplated that the concepts described herein could be modified to create a dual remote control and crew-served weapon station that is compatible with any other weapon that can be mounted to a weapon platform. Moreover, although the different examples may be described separately, any of the features of any of the examples may be added to, omitted from, or combined with any other example.

Some of the examples described herein further include an operating mode (e.g., safety mode) that is important for the safety of both the weapon's operator and other personnel who are near the weapon and its mount. In a typical crew-served weapon mount, this safety mode is activated when a weapon is not manned and secures the weapon so it cannot be fired. This safety mode is activated from a "dead-man" switch integrated into the weapon grip. When the operator holds the weapon grip, the switch is depressed, allowing the weapon to be operated. When the switch is released, an electrical or mechanical linkage stops the weapon from firing.

In addition to uncontrolled firing, an unconstrained weapon mount can cause injury to nearby personnel as it swings with platform motion. In addition to securing the weapon from firing, a safety mode should also prevent free weapon motion. The examples described herein provide both of these protections by integrating the safety or dead-man sensors with the operator sensors. The system controller then activates interlocks and steering motors to both secure the weapon and lock its position.

Figure 1B:
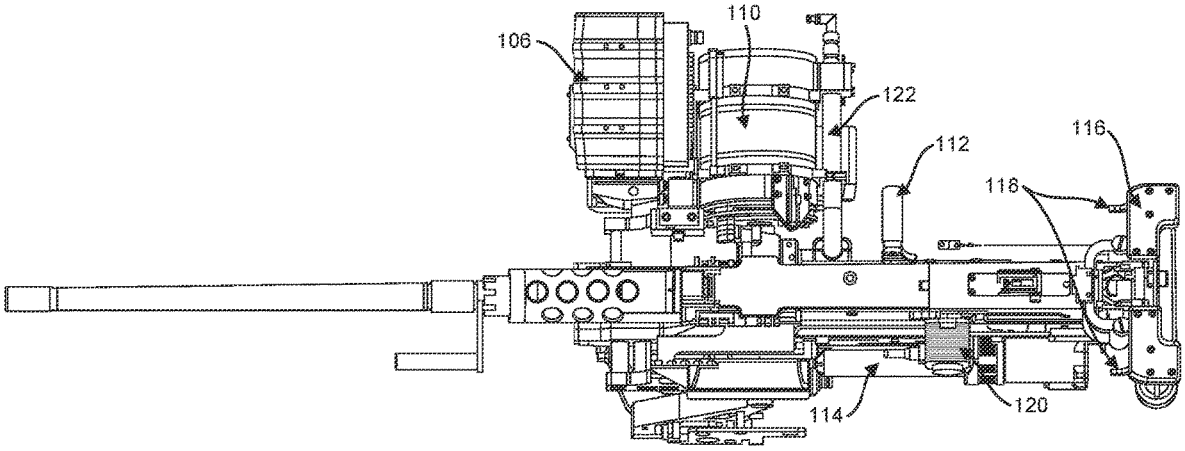
FIG. 1B is a plan-view schematic illustration of the example weapon platform and weapon of FIG. 1A.

FIG. 1A is a side-view schematic illustration of an example weapon platform and a weapon attached thereto, both of which can be controlled locally and remotely. FIG. 1B is a plan-view schematic illustration of the example weapon platform and weapon of FIG. 1A. For the example of FIG. 1A, weapon platform 100 comprises cradle 102, a gimbal, and a controller. Cradle 102 has a shape and size configured to receive and secure weapon 104. In the example shown in FIG. 1A, weapon 104 is an M2 machine gun. In other examples, cradle 102 could be modified to receive any other suitable weapon.

The gimbal is integrally formed within weapon platform 100 and stabilizes cradle 102 by selectively controlling pan and tilt angles of cradle 102. More specifically, the gimbal utilizes motors to steer and stabilize weapon 104, which is attached to weapon platform 100. For example, pan assembly 108 is utilized to adjust the pan angle of cradle 102 (e.g., generally considered to be a pivoting movement about a vertical axis to aim weapon 104 to the right/left).

Tilt motor 110 is utilized to adjust the tilt angle of cradle 102 (e.g., generally considered to be a pivoting movement about a horizontal axis to aim weapon 104 up/down). When weapon platform 100 and weapon 104 are being operated remotely, control signals are received via network conduit 122 from a remote control station that indicate what adjustments should be made to the pan and tilt angles of cradle 102. Based on the received control signals, pan assembly 108 and tilt motor 110 adjust the pan and tilt angles of cradle 102, respectively.

The controller of weapon platform 100 is configured to cause weapon 104 to selectively operate in one of at least three operating modes. For the example shown in FIG. 1A, the first operating mode is a mode in which weapon 104 is remotely steered and fired (e.g., remote controlled), via a remote control station, by a remote operator. In some examples, the first operating mode is a stabilized operating mode. In other examples, the first operating mode is a non-stabilized operating mode.

The second operating mode is a mode in which cradle 102 is stabilized by the gimbal and weapon 104 is aimed, charged, and fired by a local operator (e.g., crew-served stabilized). Thus, the second operating mode permits the local operator to manually manipulate the weapon. For example, the local operator can locally aim weapon 104 via a joystick (e.g., similar to joystick 212 shown in FIG. 2B) located on the grip of weapon 104. In further examples, the local operator can engage/disengage the stabilization feature via a button (e.g., similar to button 210 shown in FIG. 2B) located on a grip of weapon 104.

Disengagement of the stabilization feature will cause the weapon platform 100 to begin operating in the third operating mode. The third operating mode is a mode in which cradle 102 is manually steered and weapon 104 is manually aimed, charged, and fired by the local operator (e.g., full manual). Some examples also include a fourth operating mode (e.g., safety mode) in which the pointing direction of weapon 104 is locked by the gimbal and weapon 104 is secured (e.g., prevented) from firing.

As mentioned above, weapon platform 100 includes a controller configured to cause weapon 104 to selectively operate in one of the operating modes. The controller utilizes outputs from various sensors (e.g., switches and buttons) to select the current operating mode. In this regard, application or removal of an input signal (e.g., force) to one or more of the sensors is not considered to be a physical modification, manipulation, or mechanical change in the configuration of the weapon platform (e.g., which is generally required by more conventional techniques for switching between operational modes of other weapon systems).

When operating in the first operating mode, a remote operator utilizes a remote control station to send control signals, via network conduit 122, to control weapon platform 100 and weapon 104. Although network conduit 122 is shown in FIG. 1A to provide a wired connection to weapon platform 100, the connection could be wireless in other examples. The control signals are received at weapon platform 100 via a communications interface (e.g., wired or wireless) configured to communicate with a remote control station that is configured to remotely operate weapon platform 100 and weapon 104 in the first operating mode.

In some examples, the remote control station comprises one or more of the following: an electronic visual display, a remote operator sensor, a steering input control device, a charging input control device, and a firing input control device. The electronic visual display of the remote control station displays the imagery from optical system 106, which supports operation of weapon platform 100 and weapon 104, so the remote operator can see an area of interest. In other examples, additional controls for the optical system (e.g., zoom in/out) may also be included on the remote control station.

The steering input control device of the remote control station is configured to be used by a remote operator to remotely control the pan and tilt angles of cradle 102 in the first operating mode. The steering input control device of the remote control station is also used to aim weapon 104. In some examples, the remote control station includes a charging input control device configured to be used by the remote operator to remotely charge weapon 104 in the first operating mode. The firing input control device of the remote control station is configured to be used by the remote operator to remotely cause weapon 104 to fire in the first operating mode.

The remote operator sensor is configured to sense whether an operator is remotely controlling, via the remote control station, weapon platform 100 and/or weapon 104. For example, a switch or button on the remote control station can be activated or enabled to send a signal to the controller of weapon platform 100 indicating that a remote operator is controlling weapon platform 100 and/or weapon 104. Alternatively, one or more sensors can be coupled to one or more of the input control devices on the remote control station such that, when an operator imparts physical force on one or more of the input control devices, a signal is sent to the controller of weapon platform 100 indicating that a remote operator is controlling weapon platform 100 and/or weapon 104. Based, at least partially, on the presence or absence of a signal indicating that a remote operator is controlling weapon platform 100 and/or weapon 104, the controller can determine whether weapon platform 100 and/or weapon 104 should operate in the first operating mode.

In some examples, weapon platform 100 includes one or more local operator sensors configured to sense whether an operator is locally controlling the weapon mounted in the cradle. In some examples, the local operator sensors are not part of the trigger mechanism to fire the weapon mounted in the cradle. In the example shown in FIG. 1C, local operator sensor 124 is a paddle built into the outside of the left local grip of weapon 104, and another local operator sensor 124 is built into the outside of the right local grip of weapon 104. The paddles are each connected to one or more sensors. In some examples, the paddles are connected to a single, common sensor.

Figure 2A:
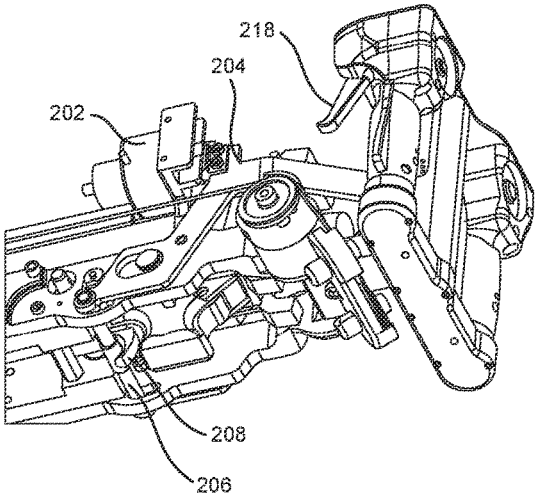
FIG. 2A is a perspective-view schematic illustration of an example internal mechanical linkage that is utilized by both a remote trigger actuator and a local mechanical trigger to fire a weapon without direct access to an internal trigger. The example internal mechanical linkage of FIG. 2A is shown in a rest (e.g., non-firing) position.
Figure 2B:
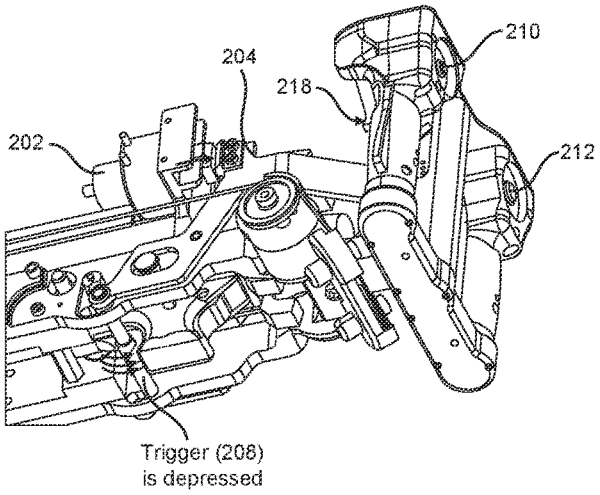
FIG. 2B is a perspective-view schematic illustration of the example internal mechanical linkage of FIG. 2A. The example internal mechanical linkage of FIG. 2B is shown in a firing position.

Both local operator sensors 124 are configured to detect local application of physical force by an operator. For example, when an operator grasps one or both of the local grips, the corresponding paddles of the local operator sensors 124 are automatically depressed, which causes the sensor(s) to send a signal to the controller indicating that an operator is locally controlling weapon 104. Upon detection of an operator locally controlling the weapon, the controller selectively operates weapon platform 100 in either the second operating mode or the third operating mode. More specifically, if a local operator is controlling weapon 104, the controller enables local operation of weapon platform 100 and weapon 104, wherein the local operator can selectively operate weapon platform 100 and weapon 104 in either the second operating mode or the third operating mode by enabling/disabling the stabilization feature via button 210 located on a grip of weapon 104, as shown in FIGS. 2A-2B.

In the examples that include a safety mode, the components and functionality of the safety mode are fully integrated with the other operational modes and system sensors. For example, an RWS includes "operator present" sensors at both the crew-served position (e.g., local) and the remote control station. In the examples that include a safety mode, the operator sensors also serve as safety sensors.

Figure 1C:
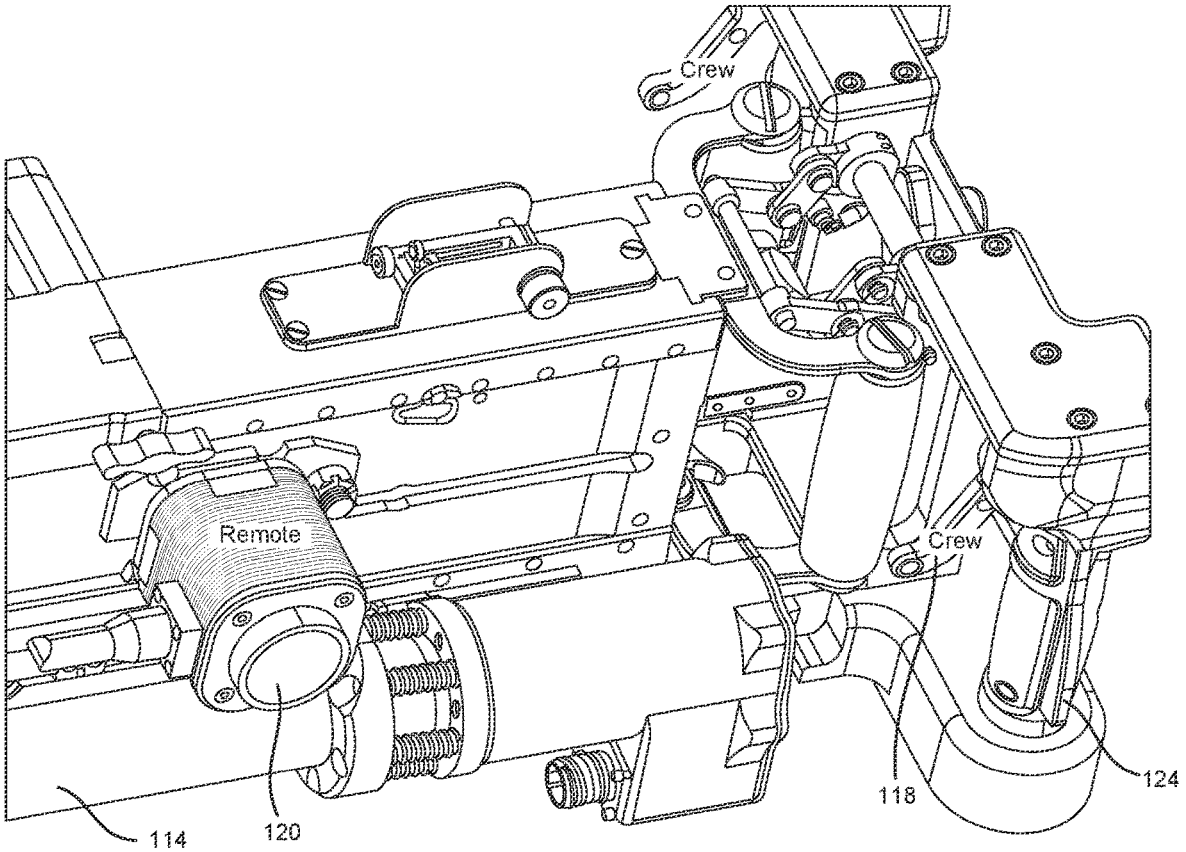
FIG. 1C is a perspective-view schematic illustration of a remote trigger actuator, a remote charging actuator, a local mechanical trigger, and a local operator sensor of the example weapon platform and weapon of FIG. 1A.

In some of these examples, the local safety sensor is embedded in the weapon grip, so that the operator necessarily depresses it when operating the weapon. FIG. 1C shows an example in which the safety and local operator sensor is a palm switch (e.g., reference character 124), which is depressed when the operator holds the weapon grip. This switch, which is sensed by the system controller, secures the weapon from firing when it is released. In this manner, the system controller determines when the weapon should operate in the safety mode, in which the controller sends control signals to the motors to hold the angular position of the weapon constant. The safety mode is different from stabilization, which compensates for platform motion to keep the weapon aimed at a target. Instead, the safety mode locks the weapon at a fixed angular position so that the weapon moves with the platform.

In other examples, the controller can direct the motors to move the weapon to a stow location. In these examples, the controller may direct the motors to move the weapon to a position in which the weapon barrel is pointed upwards and then hold the weapon's position at this stow location. In some examples, the weapon platform uses direct drive motors to lock the pointing direction of the weapon. In other examples, an electro-mechanical brake is used to lock the pointing direction of the weapon.

The controller also senses the presence and state of remote control equipment, including optical sensor, remote control station, and remote control communications channel. As with the local grip, the remote control station also includes a dual purpose safety and operator sensor built into the remote control station. This sensor can be a palm switch on a handheld controller or on a joystick or panel-mounted controller. Other suitable switch types and positioning are possible, as long as the switch must be depressed to remotely control the weapon.

The weapon can be steered and operated either locally from the crew-served position or remotely via a compatible remote control station. It is not necessary for the weapon system to be connected continually, or even intermittently, to a remote control station. The safety mode is activated when there is no operator present, even when a remote control station is not part of the weapon station.

In some examples, the weapon station includes a controller or processing unit, which senses the presence of an operator at the crew (e.g., local) position and also senses when a remote control station is present, active, and an operator is at the remote control station. The controller then decides in what mode the system should operate. When the safety mode is selected, the controller sends one or more control signals to provide electrical interlocks to prevent remote steering or operation of the weapon. In addition, the controller sends one or more control signals to provide electrical and mechanical interlocks to prevent the weapon from swinging freely, or from being locally fired.

When local operation is selected, the controller sends one or more control signals to provide electrical interlocks to prevent remote steering or operation of the weapon. This controller can be implemented with electronics and/or using computer software. In some examples, a combination of software, digital (electronic) logic, and electrical interlocks are used to ensure only one operator (e.g., local or remote) can control the weapon at a time.

In some examples, the controller uses the logic defined in Table 1 to select the operating mode (e.g., safety mode, local control, or remote control). The intent of this decision logic is to maintain safe operation at all times, while still providing conventional mount operation when power is lost. The presence and automatic activation of safety mode does not impact the other operational modes. The operator retains the ability to disable stabilization during local control for fast, free motion. Smooth transition between local and remote operation remains consistent with the other examples described herein. In some examples, the system reverts to conventional mount behavior when power is lost. The logic table shown in Table 1 is given as an example of one possible implementation of interlock control logic.

TABLE 1

| Gimbal | Grip | Optics | Remote | |
|---|---|---|---|---|
| Off | X | X | X | Free motion of conventional mount |
| On | Operator present | Not present | Not present | Local control, stabilization available |
| | | Present | Off | Local control, stabilization available<br>Can show video on a display screen |
| | | | On and operator present | Local control, stabilization available<br>Remote: can display video, but has no steering or weapon control |
| | | | On and no operator | Local control, stabilization available<br>Remote: can display video, but has no steering or weapon control |

TABLE 1-continued

| Gimbal | Grip | Optics | Remote | |
|---|---|---|---|---|
| | No operator | Not Present | Not present | Safety mode |
| | | Present | Off | Safety mode<br>Can show video on a display screen |
| | | | On and operator present | Full remote control |
| | | | On and no operator | Safety mode<br>Remote: can display video, but has no steering or weapon control |

Thus, when no operator is sensed by either the local operator sensor or the remote operator sensor, the system enters the safety mode, in which the pointing direction of the weapon is locked and the weapon is secured from firing. In some examples, safety equipment is used to selectively lock the pointing direction of the weapon and secure the weapon from firing. The safety equipment may include an electromechanical brake and/or a gimbal having motors which, when active, control the pointing direction of the weapon mounted in the cradle, in some examples.

In operation, when the weapon is operating in an operating mode in which the weapon is aimed and fired by a local operator, in response to receiving an indication from the local operator sensor indicating that the local operator is not locally controlling the weapon mounted in the cradle, the controller sends one or more control signals to the safety equipment to lock the pointing direction of the weapon and secure the weapon from firing, in some examples. In some further examples, prior to sending the one or more control signals to the safety equipment to lock the pointing direction of the weapon and secure the weapon from firing, the controller causes the weapon to operate in an operating mode in which the weapon is remotely steered and fired. In still further examples, the controller sends, in response to receiving an indication from a remote operator sensor indicating that no operator is remotely controlling the weapon mounted in the cradle, one or more control signals to the gimbal to lock the pointing direction of the weapon.

Once the pointing direction of the weapon is locked and the weapon is secured from firing, the system is also designed to allow an operator to begin controlling and firing the weapon. For example, when the weapon is operating in an operating mode in which the pointing direction of the weapon is locked and the weapon is secured from firing, the controller, in response to receiving a signal from the local operator sensor indicating that a local operator is locally controlling the weapon mounted in the cradle, causes the weapon to operate in an operating mode in which the weapon is aimed and fired by the local operator. Similarly, when the weapon is operating in an operating mode in which the pointing direction of the weapon is locked and the weapon is secured from firing, the controller, in response to receiving a signal from a remote operator sensor indicating that a remote operator is remotely controlling the weapon mounted in the cradle, causes the weapon to operate in an operating mode in which the weapon is remotely steered and fired.

Thus, it is not necessary for the operator to physically secure the system. Rather, the same mechanisms that implement local and remote operation of the weapon advantageously also implement the safety mode.

In some examples, weapon platform 100 includes an interlock control, which prevents weapon platform 100 and/or weapon 104 from being simultaneously controlled by a remote operator and a local operator. For example, in weapon platforms that have the interlock control feature, the controller of weapon platform 100 is configured to prevent simultaneous operation of weapon 104 in both the first operating mode and the second operating mode. Thus, as described above, the controller of weapon platform 100 utilizes the output from one or more sensors (e.g., local operator sensors 124 and remote operator sensors) to determine (1) whether a local operator is controlling weapon platform 100 or weapon 104, and/or (2) when a remote operator is attempting to control weapon platform 100 or weapon 104 via a remote control station. Based on the output from the one or more sensors, the controller of weapon platform 100 decides when remote operation should be allowed. Thus, in some examples, if a local operator is controlling weapon platform 100 or weapon 104, the controller of weapon platform 100 selects local operation (e.g., in either the second or third operating modes) and provides electrical interlocks to prevent remote operation of the trigger and charging mechanisms.

The controller of weapon platform 100 implements the electrical interlocks via electronics and/or computer software. In one example, a combination of software, digital (electronic) logic, and electrical interlocks are used to ensure only one operator (e.g., local or remote) can control weapon platform 100 and/or weapon 104 at a time. In other examples, the controller of weapon platform 100 may allow weapon platform 100 and/or weapon 104 being simultaneously controlled by a remote operator and a local operator. In further examples, the controller of weapon platform 100 may allow some operations to be controlled remotely while others are controlled locally. Although not required, the interlock control feature makes weapon platform 100 safer for the crew that is operating weapon platform 100 and weapon 104.

The remote control station is not necessarily committed to a single weapon platform. For example, a single remote control station could be dedicated to one weapon platform and a weapon attached thereto. Alternatively, a remote control station can be configured to switch between remotely operating (1) a first weapon platform and a first weapon attached to the first weapon platform, and (2) a second weapon platform and a second weapon attached to the second weapon platform. In still further examples, a remote control station can be configured to simultaneously remotely operate multiple weapon platforms and/or weapons attached to the weapon platforms.

In some examples, weapon platform 100 further includes optical system 106, which can be fixed mounted and aligned with weapon 104. This configuration provides a coordinated operational mode, in which the scope (e.g., optical system) moves with the weapon gimbal and provides a live view of the field of regard that always shows the area where weapon 104 is aimed. In these examples, optical subsystem 106 is mounted to the weapon station gimbal. In other examples, a separately gimbaled optical system can be used. Thus, optical subsystem 106 can be configured to either move with weapon 104 (i.e. hard mounted) or independently of weapon 104. Any optical components that meets the interface requirements of weapon platform 100 can be used.

Optical system 106 delivers real-time, continuous imagery of resolution consistent with the range of weapon 104 to a remote control station. Optical system 106 includes one or more cameras, optional laser components, a control processing unit, a video interface, and a control interface. In some examples, optical system 106 includes two high definition daylight cameras, two thermal cameras, and a laser range finder that provide useful imagery and ranges beyond the operational range of the M2 machine gun. Optical system 106 also incorporates a video processor that provides both video processing and access to a network for supplying video and accepting commands.

In some examples, the real-time, continuous imagery provided by optical system 106 is displayed to a local operator via an electronic visual display that can be mounted on (e.g., physically coupled to) any suitable location on the frame (e.g., on the base or the weapon cradle) of the weapon platform, on the weapon mounted in the cradle, or on a grip of the weapon mounted in the cradle. This electronic visual display is configured to allow a local operator to see a magnified image around the aim point of the weapon for identification of potential targets while simultaneously maintaining normal visual situational awareness. In this manner, the electronic visual display provides the same functionality as a typical weapon scope.

In some examples, any suitable information may be overlaid on top of the imagery being displayed by the electronic visual display. Examples of suitable information include: a number of rounds that have been fired from the weapon mounted in the cradle, a number of rounds remaining (e.g., available to be fired by the weapon mounted in the cradle), a distance to target, and a distance to aimpoint. Any other information regarding the status/condition of the weapon platform, the weapon mounted in the cradle, the target, or the operational environment of the weapon platform may also be overlaid on top of the imagery being displayed by the electronic visual display.

In other examples, the real-time, continuous imagery provided by optical system 106 is displayed to a remote operator via an electronic visual display of a remote control station. In this manner, optical system 106 gives a remote operator both situational awareness and target identification and engagement capability. For example, as mentioned above, optical system 106 may include a range measurement device, such as a laser range finder, to give an operator the ability to measure range to target. In further examples, optical system 106 may include any other suitable imaging device.

A local network connects the control units of the remote control station, optical system 106, and weapon platform 100. This network enables communication between the remote control station and weapon platform 100 for aiming and other control. It also provides communication between the remote control station and the optical system 106 for control of the optical system components and reception of optical system imagery. The term "local network" in this context is used in its broadest technical sense, not as short-hand for Ethernet using TCP/IP protocols. A network can consist of a combination of serial and/or parallel interfaces (SPI, I2C, USB, UART, RS232, RS422, CameraLink, PCI, etc.) that allow the processors embedded in weapon platform 100, optical system 106, and remote control station to communicate and share information using a common application level protocol.

The term "charging" a weapon is used herein to describe the act of preparing a weapon to fire by pulling/pushing a bolt assembly of the weapon to a "charged" position in which a round of ammunition is loaded into a chamber of the weapon. For example, the charging mechanism on a weapon pulls/pushes back the bolt and cycles ammunition rounds into the weapon. The weapon provides a manual charging handle, which a local operator uses to ready the weapon.

For weapons that fire from an open bolt position (like the M240), when an operator then depresses the trigger, the bolt releases and moves forward, driving the firing pin into the back of the ammunition cartridge. When the firing pin strikes a primer on the back of the ammunition cartridge, the primer ignites propellent within the ammunition cartridge, which drives the bullet from the chamber. The forces associated with the propellent explosion push the bolt back, causing the spent ammunition casing to be ejected. As long as the trigger of a fully-automatic machine gun is depressed, the bolt drives forward again, loading and firing the next cartridge.

The mechanical design of the bolt is at the heart of how a machine gun can maintain automatic fire. Consequently, a remote charging mechanism is not simply a mechanism to pull back the bolt. It must integrate fully with the weapon design, so it does not interfere with the normal recoil cycle of the bolt during operation.

The remote charging mechanisms described herein incorporate an electrically controlled mechanism that, when actuated, cause the bolt assembly of the weapon to move from a rest position to a charged position. Once the bolt assembly is moved to the charged position and the weapon is charged, the bolt assembly is allowed to move forward and fire a chambered round of ammunition when the trigger is depressed. FIG. 1A shows an example of a remote charging mechanism for the M2 machine gun. Other weapons that utilize mechanically different local charging mechanisms may require different remote charging mechanisms.

In the example shown in FIG. 1A, weapon platform 100 includes (1) a first charging mechanism configured to remotely cause weapon 104 to charge in the first operating mode (e.g., remote controlled), and (2) a second charging mechanism configured to locally cause weapon 104 to charge in either the second operating mode (e.g., crew-served stabilized) or the third operating mode (e.g., full manual). The first charging mechanism comprises electrically activated linear actuator 114, which when electrically activated by a remote operator, is configured to mechanically move a bolt assembly of weapon 104 in a manner to charge weapon 104. In some examples, the remote operator utilizes a remote control station to send a control signal to electrically activate actuator 114 in order to remotely charge weapon 104.

Figure 3:
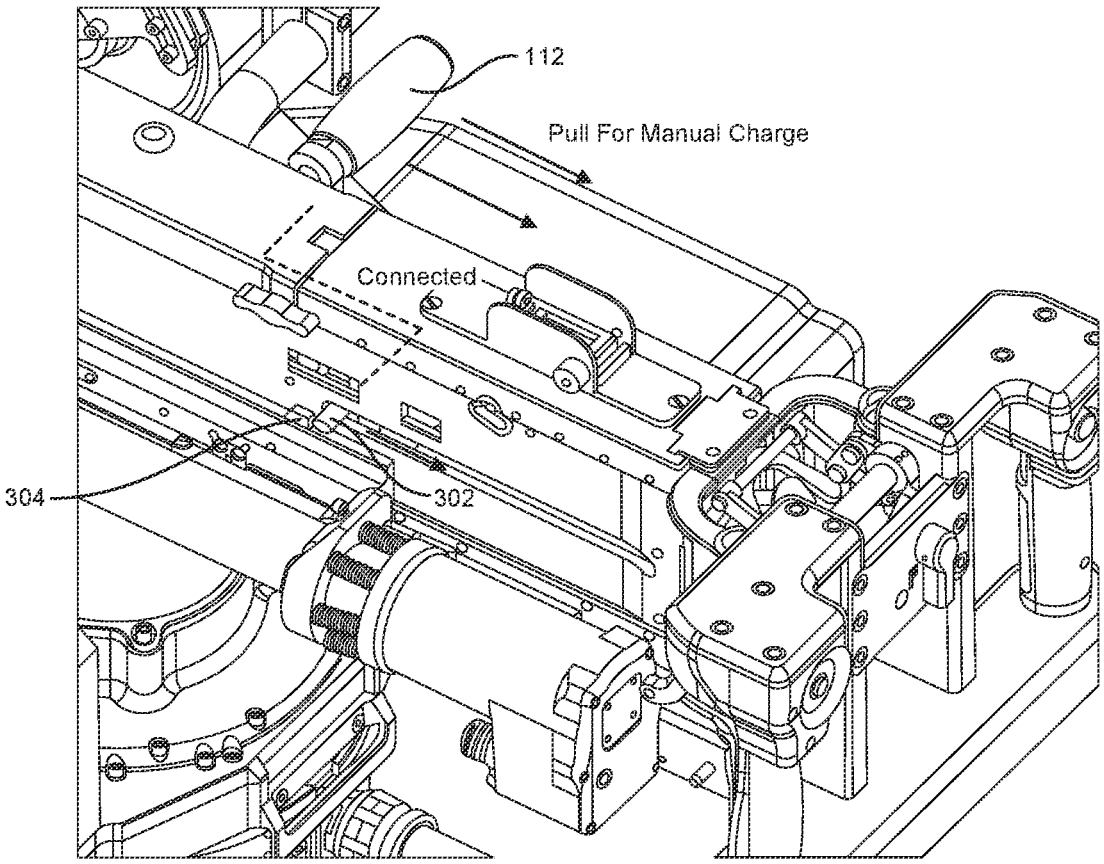
FIG. 3 is a perspective-view schematic illustration of an example local charging handle and remote charging actuator, both of which are configured to charge the weapon of FIG. 1A.
Figure 4:
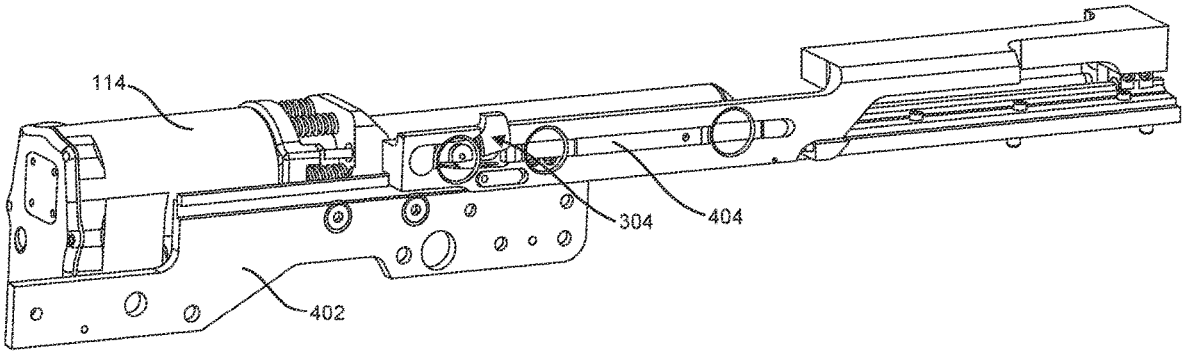
FIG. 4 is a perspective-view schematic illustration of an example strut and pusher, which are configured to charge the weapon of FIG. 1A when moved by the remote charging actuator of FIG. 3.

Additional details of the first charging mechanism are shown in FIGS. 3-4. For example, as shown in FIG. 4, the first charging mechanism further comprises adapter plate 402 to connect the first charging mechanism to weapon platform 100. The first charging mechanism additionally comprises strut mechanism 404. As shown in FIG. 3, the bolt assembly of weapon 104 is connected to charging handle 112 and to charging pin 302. The dashed line of FIG. 3 further illustrates that charging handle 112 and charging pin 302 are mechanically coupled to each other.

To charge the weapon remotely, a remote operator activates linear actuator 114, via a remote control station, which moves strut 404 back towards the rear of weapon 104. In the example shown, "pusher" 304 is comprised of bronze and is coupled to strut 404. The movement of strut 404 rearward causes pusher 304 to engage charging pin 302 and push charging pin 302 back, which pushes the bolt assembly of weapon 104 back to the charged position.

When the bolt assembly reaches its travel limit (e.g., at the charged position), pusher 304 automatically retracts out of the way of charging pin 302, releasing the bolt assembly, which is now free to slam forward to load and fire weapon 104. Pusher 304 remains retracted while strut 404 is driven by actuator 114 back to its home position. When strut 404 comes to its home position, a linkage extends pusher 304, and a latch engages to keep pusher 304 extended, making pusher 304 ready for the next charge cycle.

In home position, strut 404 and pusher 304 are safely in front of charging pin 302, so they do not interfere with normal firing operation of weapon 104. Since pusher 304 is forward of charging pin 302 when in home position, the first charging mechanism does not interfere with manual charging of weapon 104. Thus, in the examples described herein, the first charging mechanism and the second charging mechanism do not interfere with each other in any of the operating modes.

The second charging mechanism comprises charging handle 112 coupled to the bolt assembly of weapon 104. Charging handle 112 is configured to charge weapon 104, in response to an operator locally applying physical force to charging handle 112. More specifically, a local operator charges weapon 104 by pulling charging handle 112 from a rest position, as shown in FIG. 3, to a charged position that is closer to the rear of weapon 104 than the rest position. Once charging handle 112 reaches its travel limit, the local operator releases charging handle 112, and charging handle 112 automatically returns back to its rest position. The local operator can always charge or clear weapon 104 using charging handle 112.

Figure 5:
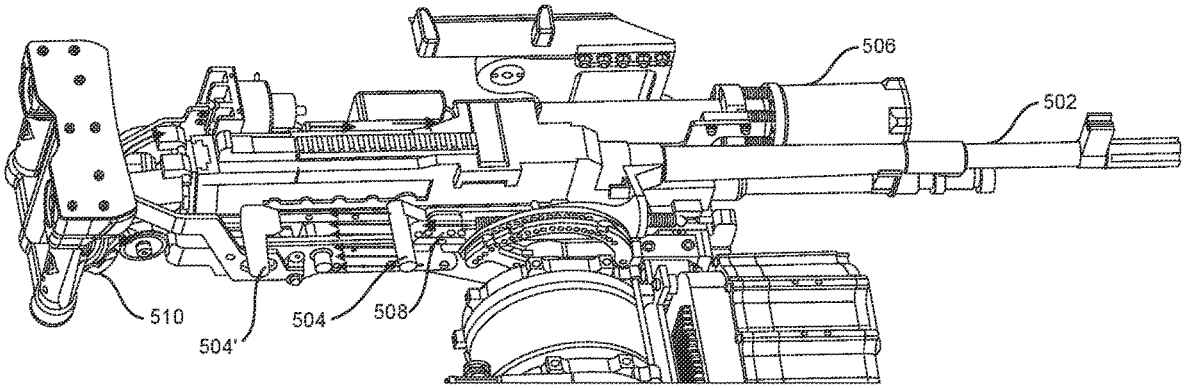
FIG. 5 is a perspective-view schematic illustration of an alternative example local charging handle and remote charging actuator, both of which are configured to charge the weapon shown in FIG. 5.
Figure 6:
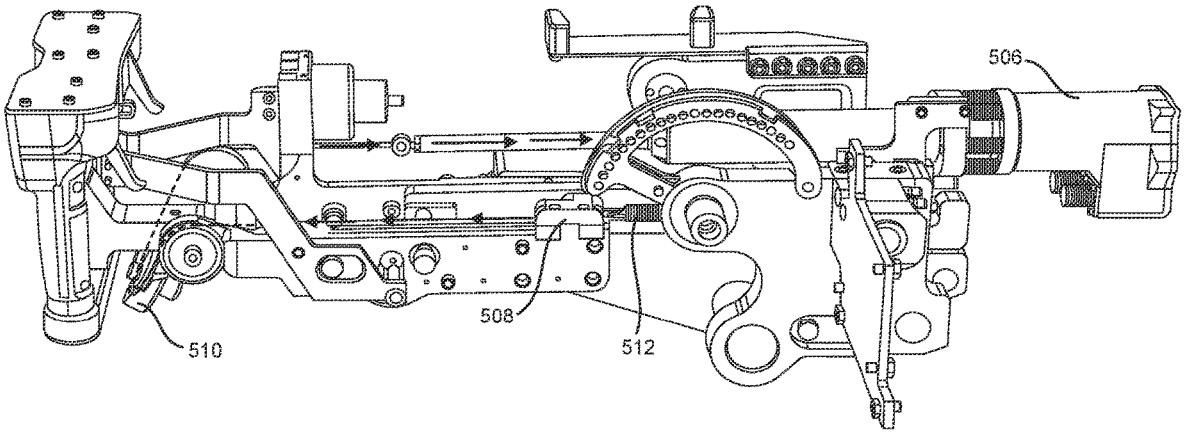
FIG. 6 is a side-view schematic illustration of the remote charging actuator of FIG. 5, which is configured to pull a sled to move the local charging handle of the weapon, via a pulley and cable system, to a charged position.

FIGS. 5-6 shows an alternative example of a remote charging mechanism for the M240 machine gun. The example shown in FIGS. 5-6 includes (1) a first charging mechanism configured to remotely cause weapon 502 to charge in the first operating mode (e.g., remote controlled), and (2) a second charging mechanism configured to locally cause weapon 502 to charge in either the second operating mode (e.g., crew-served stabilized) or the third operating mode (e.g., full manual). The first charging mechanism comprises electrically activated actuator 506, which when electrically activated by a remote operator, is configured to mechanically move a bolt assembly of weapon 502 in a manner to charge weapon 502. In the example shown in FIGS. 5-6, the first charging mechanism additionally comprises sled 508, cable and pulley system 510, and spring 512. In some examples, the remote operator utilizes a remote control station to send a control signal to electrically activate actuator 506 in order to remotely charge weapon 502.

In the example shown in FIGS. 5-6, actuator 506 is coupled to sled 508 via a cable and pulley system 510, in which a cable is coupled to actuator 506 on the left side of weapon 502, runs along the left side of weapon 502, runs over the top of at least one pulley on the left side of weapon 502, descends underneath weapon 502, runs underneath at least one central pulley, ascends on the right side of weapon 502, runs over the top of at least one pulley on the right side of weapon 502, runs along the right side of weapon 502, and is coupled to a rear portion of sled 508.

Sled 508 is resiliently biased towards a front end of weapon 502. In the example shown in FIGS. 5-6, sled 508 is coupled to spring 512, which has one end coupled to a front portion of sled 508 and another end coupled to an anchor point that is forward of sled 508. In the example of FIGS. 5-6, spring 512 is an extension spring that is naturally at rest in a tightly coiled, compressed position and contains the most potential energy when it is extended. In other examples, any other suitable resilient material/component may be substituted for spring 512.

In response to being activated by a remote operator, actuator 506 is configured to pull the cable with sufficient force to cause sled 508 to push charging handle 504 rearward to charged position 504'. Since charging handle 504 is coupled to the bolt assembly of weapon 502, movement of charging handle 504 to charged position 504' charges weapon 502. Once weapon 502 is charged, actuator 506 reduces, or releases, the tension that was utilized to pull the cable in order to charge weapon 502. With the tension on the cable reduced or released, spring 512 pulls sled 508 back to its rest position.

The second charging mechanism comprises charging handle 504 coupled to the bolt assembly of weapon 502. Charging handle 504 is configured to charge weapon 502, in response to an operator locally applying physical force to charging handle 504. More specifically, a local operator charges weapon 502 by pulling on charging handle 504 from a rest position, as shown in FIG. 5, to charged position 504' that is closer to the rear of weapon 502 than the rest position. Once charging handle 504 reaches its travel limit at charged position 504', the local operator releases charging handle 504, and charging handle 504 automatically returns back to its rest position. The local operator can always charge or clear weapon 502 using charging handle 504.

Once the weapon is charged, the weapon may be locally or remotely triggered to fire, as shown in the examples below. For example, the internal trigger of the weapon can be activated by a local operator applying force to an external trigger that is mechanically linked to the internal trigger. The remote trigger mechanisms described herein incorporate an electrically controlled solenoid to activate the internal trigger of the weapon. FIG. 1C shows an example of a remote trigger mechanism for the M2 machine gun. Other weapons that utilize mechanically different local trigger mechanisms may require different remote trigger mechanisms.

In the example shown in FIG. 1C, weapon platform 100 includes (1) a first trigger mechanism configured to remotely cause weapon 104 to fire in the first operating mode (e.g., remote controlled), and (2) a second trigger mechanism configured to locally cause weapon 104 to fire in either the second operating mode (e.g., crew-served stabilized) or the third operating mode (e.g., full manual). The first trigger mechanism comprises electrically controlled solenoid 120 coupled to an internal trigger of the weapon 104. Solenoid 120 is configured to activate the internal trigger from a side of weapon 104, in response to a control signal from a remote control station. In some examples, a remote operator utilizes a remote control station to send the control signal to solenoid 120 in order to remotely fire weapon 104.

The second trigger mechanism comprises at least one external trigger 118 coupled to the internal trigger of weapon 104. In the example shown in FIGS. 1A-1C, there are two external triggers 118, one on each of the local grips of weapon 104. In some examples, external triggers 118 may be operated independently. In other examples, external triggers 118 comprise two linked trigger levers, as shown and described below in connection with FIGS. 2A-2B.

External trigger 118 is configured to activate the internal trigger from a rear portion of weapon 104, in response to a local operator locally applying physical force to external trigger 118. More specifically, the local operator fires weapon 104 by squeezing/pulling at least one external trigger 118 from a rest position, which is shown in FIG. 1C, to a firing position that is closer to the rear of weapon 104 than the rest position. When the local operator chooses to cease firing weapon 104, the local operator releases external trigger 118, and external trigger 118 automatically returns to its rest position.

As described above in connection with the first trigger mechanism, when solenoid 120 is activated (e.g., extended), the internal trigger of weapon 104 is activated from a location on the side of weapon 104, which releases the bolt of weapon 104, thereby firing weapon 104. However, the second trigger mechanism utilizes external trigger 118 to activate the internal trigger of weapon 104 to release the bolt of weapon 104 from a location at the rear of weapon 104. Either trigger mechanism can release the bolt to fire weapon 104.

Consequently, the first and second trigger mechanisms do not interfere with each other. Thus, in the example shown in FIG. 1C, the first trigger mechanism and the second trigger mechanism do not interfere with each other in any of the operating modes. Likewise, in the remaining examples described herein, the first trigger mechanism and the second trigger mechanism do not interfere with each other in any of the operating modes.

FIGS. 2A-2B show an alternative example of a remote trigger mechanism for the M240 machine gun. Other weapons without direct access to an internal trigger could have a remote trigger mechanism similar to that shown in FIGS. 2A-2B. The example shown in FIGS. 2A-2B includes (1) a first trigger mechanism configured to remotely cause weapon 502 to fire in the first operating mode (e.g., remote controlled), and (2) a second trigger mechanism configured to locally cause weapon 502 to fire in either the second operating mode (e.g., crew-served stabilized) or the third operating mode (e.g., full manual).

The first trigger mechanism comprises solenoid 202 coupled to internal trigger 208 of weapon 502 via mechanical linkage 204. Solenoid 202 is configured to activate internal trigger 208, via mechanical linkage 204, in response to a control signal from a remote control station. In some examples, a remote operator utilizes a remote control station to send the control signal to solenoid 202 in order to remotely fire weapon 502. More specifically, when solenoid 202 is activated, solenoid 202 moves mechanical linkage 204 rearward, causing cross bar 206, which is coupled to mechanical linkage 204, to depress internal trigger 208. When internal trigger 208 is depressed, the bolt of weapon 502 is released, thereby firing weapon 502.

The second trigger mechanism comprises external trigger 218 coupled to mechanical linkage 204, which is coupled to internal trigger 208 of weapon 502. External trigger 218 is configured to activate internal trigger 208 via mechanical linkage 204, in response to an operator locally applying physical force to external trigger 218. Thus, the local operator fires weapon 502 by squeezing/pulling external trigger 218 from a rest position, as shown in FIG. 2A, to a firing position, as shown in FIG. 2B, which is closer to the rear of weapon 502 than the rest position. More specifically, movement of external trigger 218 to the firing position causes mechanical linkage 204 to move rearward, causing cross bar 206, which is coupled to mechanical linkage 204, to depress internal trigger 208. When internal trigger 208 is depressed, the bolt of weapon 502 is released, thereby firing weapon 502. When the local operator chooses to cease firing weapon 502, the local operator releases external trigger 218, which causes both external trigger 218 and internal trigger 208 to automatically return to their respective rest positions. Although the foregoing discussion describes external trigger 218 as a single component, external trigger 218 can comprise multiple, linked trigger levers, as shown in FIGS. 2A-2B. Thus, a local operator can activate external trigger 218 by applying physical force to either one of the trigger levers, or both, to fire weapon 502.

Thus, for the example shown in FIGS. 2A-2B, solenoid 202 and external trigger 218 are both connected to the same mechanical linkage 204, which activates internal trigger 208. Therefore, when either solenoid 202 or external trigger 218 are activated, the same mechanical linkage 204 moves cross bar 206 to depress internal trigger 208. Obviously, the first and second trigger mechanisms in FIGS. 2A-2B do not interfere with each other since they utilize a common component to fire weapon 502. Stated differently, either trigger mechanism can release the bolt to fire weapon 502. Thus, in the example shown in FIG. 2A-2B, the first trigger mechanism and the second trigger mechanism do not interfere with each other in any of the operating modes.

In some examples, the controller of weapon platform 100 is configured to (1) determine a geographical location of a current aimpoint of weapon 104, and (2) cause the gimbal of weapon platform 100 to maintain weapon 104 aimed at the determined geographical location. For example, the controller of weapon platform 100 may be configured to (1) determine a geographical position and orientation of weapon platform 100 based, at least partially, on output from a position sensor and an attitude sensor mounted on weapon platform 100, and (2) determine the geographical location of the current aimpoint of weapon 104 based, at least partially, on the determined geographical position and orientation of weapon platform 100. More specifically, weapon platform 100 could have position and attitude sensors, such as a Global Navigation Satellite System (GNSS) antenna and receiver, inertial measurement unit (IMU), and/or barometer, mounted in the base. The embedded gimbal processor can monitor these sensors to establish its geographical position and orientation. When commanded by the operator (e.g., from either the crew-served or remote control positions), the gimbal can calculate the current geographical location of the current aimpoint, and then automatically keep weapon 104 aimed at that location by driving the gimbal motors. Thus, in some examples, this unique geographical pointing capability is embedded in weapon platform 100, instead of relying on platform navigation data.

In some examples, weapon platform 100 also includes a fired round sensor configured to sense when a round has been fired from weapon 104. In these cases, the controller of weapon platform 100 is configured to monitor output from the fired round sensor to determine how many rounds have been fired from weapon 104. For example, the fired round sensor can be an accelerometer coupled to weapon platform 100. In some examples, the accelerometer is a three-axis accelerometer mounted in the base of weapon platform 100. The embedded gimbal processor monitors this accelerometer and computes rounds fired from the accelerometer time series.

The weapon platform 100 can further include an electronic visual display configured to display at least one of the following values determined by the controller: a number of rounds that have been fired from weapon 104, and a number of rounds remaining (e.g., available to be fired by weapon 104). In some examples, the electronic visual display is located on a grip of weapon 104. In other examples, the electronic visual display is located on a remote control station that is configured to remotely operate weapon 104 in the first operating mode.

Figure 7:
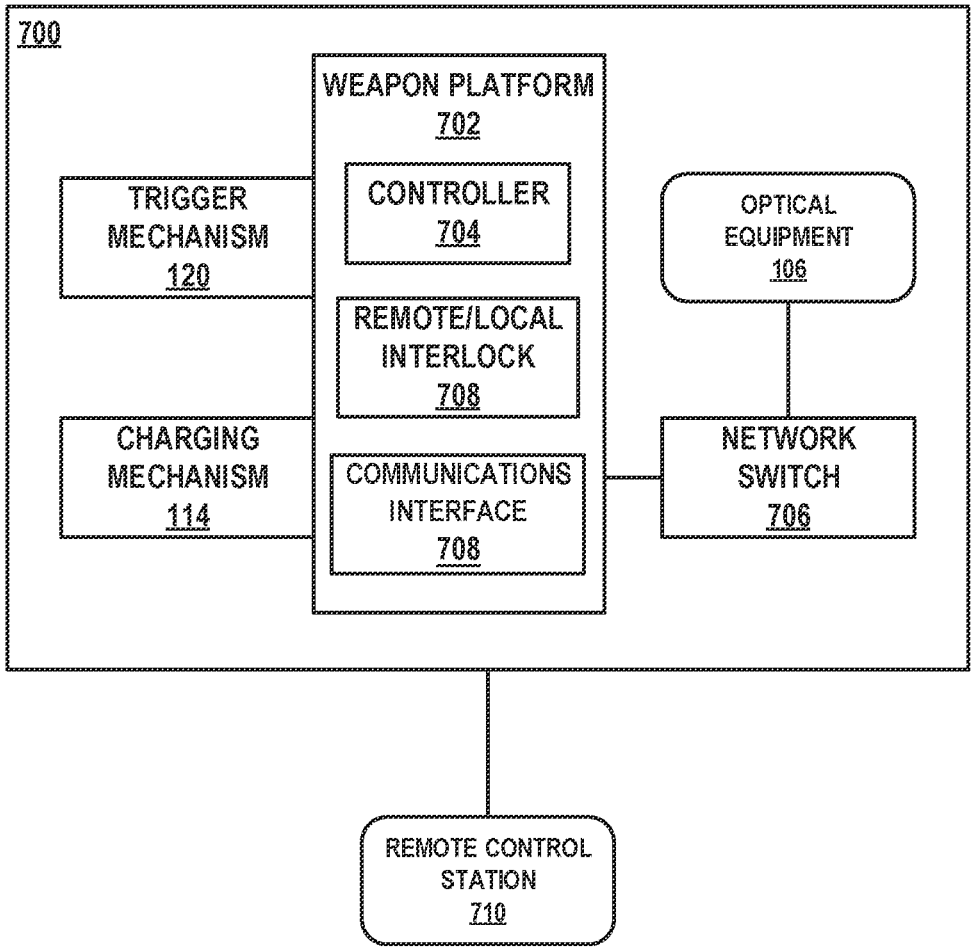
FIG. 7 is a block diagram of an example system that includes a weapon platform, a remote triggering mechanism, a remote charging mechanism, and a remote control station.

FIG. 7 is a block diagram of an example of a dual remote control and crew-served weapon station system 700. System 700 includes weapon platform 702, which is comprised of (1) a cradle having a shape and size configured to receive and secure a weapon, (2) a gimbal which, when active, stabilizes the cradle by selectively controlling pan and tilt angles of the cradle. The weapon includes a local operator sensor configured to sense whether an operator is locally controlling the weapon mounted in the cradle.

Weapon platform 702 further includes controller 704 configured to cause the weapon mounted in the cradle to operate in a first operating mode in which the weapon is remotely steered and fired via remote control station 710. Weapon platform 702 also includes communications interface 708 (e.g., which may be wired or wireless) configured to communicate with remote control station 710 that is configured to remotely operate weapon platform 702 and the weapon attached to weapon platform 702 in the first operating mode.

In the example of FIG. 7, trigger mechanism 120 remotely triggers the weapon to fire, upon receipt of a firing control signal from remote control station 710. The example of FIG. 7 also includes charging mechanism 114 that remotely charges the weapon, upon receipt of a charging control signal from remote control station 710. Controller 704 is further configured to prevent simultaneous operation of the weapon mounted in the cradle in both the first operating mode and the second operating mode.

In response to the local operator sensor sensing that an operator is locally controlling the weapon, controller 704 causes the weapon to selectively operate in either (1) a second operating mode in which the cradle is stabilized by the gimbal and the weapon is aimed and fired by the local operator, and (2) a third operating mode in which the cradle is manually steered and the weapon is fired by the local operator.

System 700 further includes optical system 106, which can be fixed mounted and aligned with the weapon, as described above. Thus, optical subsystem 106 can be configured to either move with the weapon (i.e. hard mounted) or independently of the weapon. Optical system 106 delivers real-time, continuous imagery of a resolution consistent with the range of the weapon to remote control station 710 via network switch 706. In other examples, the real-time, continuous imagery provided by optical system 106 is displayed to a local operator via an electronic visual display that can be mounted on (e.g., physically coupled to) any suitable location on the frame (e.g., on the base or the weapon cradle) of the weapon platform, on the weapon mounted in the cradle, or on a grip of the weapon mounted in the cradle.

Network switch 706 is part of a local network that connects the control units of remote control station 710, optical system 106, and weapon platform 702. The local network enables communication between remote control station 710 and weapon platform 702 for aiming and other control. The local network also provides communication between remote control station 710 and optical system 106 for control of the optical system components and reception of optical system imagery.

In other examples, one or more of the components of system 700 may be omitted, combined, moved, or modified to operate in a manner other than that described herein or shown in FIG. 7. In still further examples, additional components/features described herein may be added to system 700 that are not explicitly described in connection with the example shown in FIG. 7.

Figure 8:
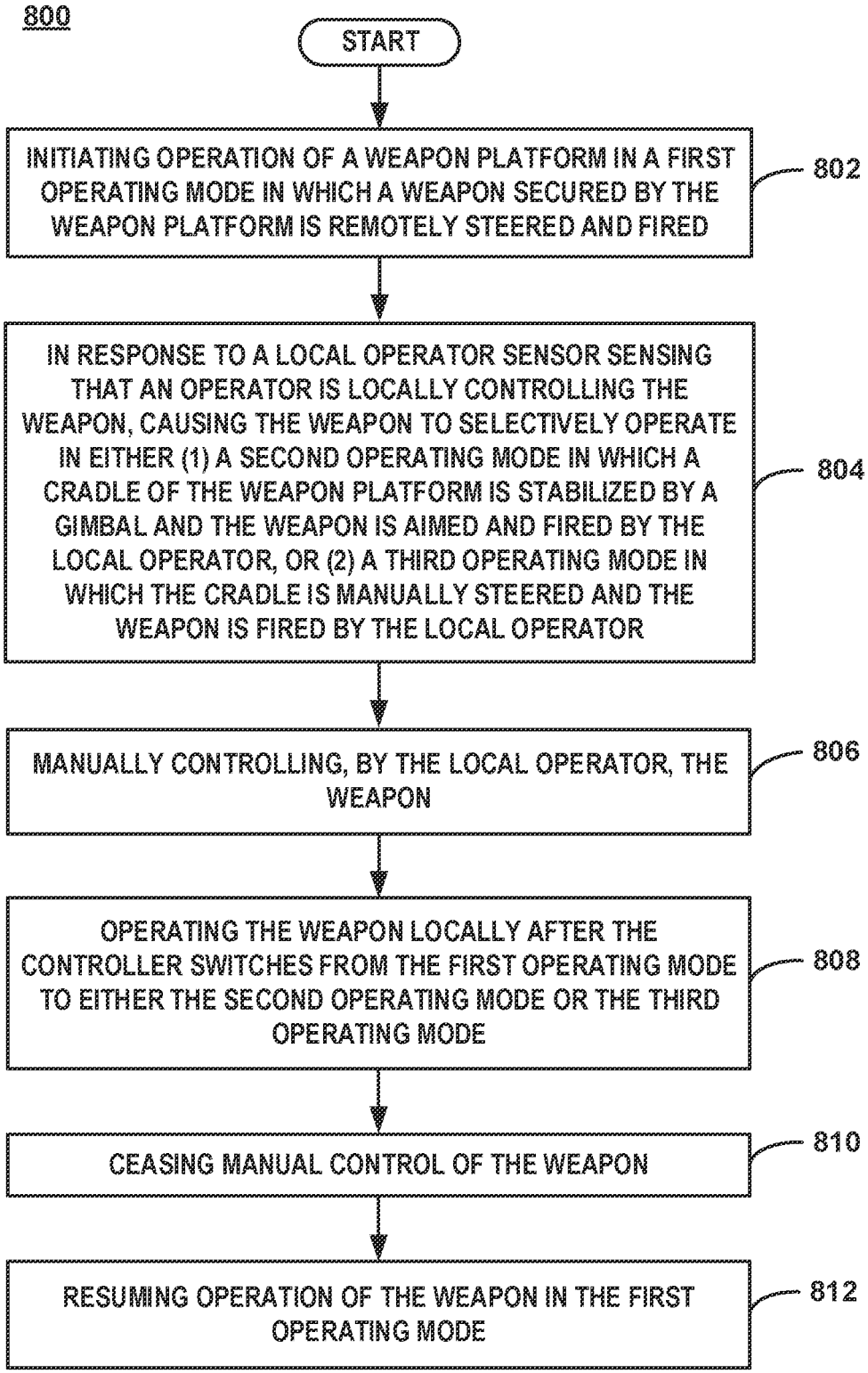
FIG. 8 is a flowchart of an example of a method in which operation of a weapon platform is initiated in a first operating mode in which a weapon attached to the weapon platform is remotely steered and fired; a local operator manually controls the weapon; and the local operator operates the weapon locally after a controller of the weapon platform switches from the first operating mode to another operating mode in which the local operator locally fires the weapon.

FIG. 8 is a flowchart of an example of a method of operating a dual remote control and crew-served weapon station system. The method 800 begins at step 802 with initiating operation of a weapon platform in a first operating mode in which a weapon secured by the weapon platform is remotely steered and fired. At step 804, in response to a local operator sensor sensing that an operator is locally controlling the weapon mounted in a cradle of the weapon platform, the weapon is caused to selectively operate in either a second operating mode or a third operating mode. The second operating mode is a mode in which the cradle is stabilized by a gimbal and the weapon is aimed and fired by the local operator. The third operating mode is a mode in which the cradle is manually steered and the weapon is fired by the local operator.

At step 806, the local operator manually controls the weapon. At step 808, the weapon is locally operated after the controller switches from the first operating mode to either the second operating mode or the third operating mode. At step 810, the operator ceases manual control of the weapon. At step 812, operation of the weapon in the first operating mode is resumed.

In other examples, one or more of the steps of method 800 may be omitted, combined, performed in parallel, or performed in a different order than that described herein or shown in FIG. 8. In still further examples, additional steps may be added to method 800 that are not explicitly described in connection with the example shown in FIG. 8. Similarly, any of the features of any of the methods described herein may be performed in parallel or performed in a different manner/order than that described or shown herein.

Clearly, other examples and modifications of the foregoing will occur readily to those of ordinary skill in the art in view of these teachings. The above description is illustrative and not restrictive. The examples described herein are only to be limited by the following claims, which include all such examples and modifications when viewed in conjunction with the above specification and accompanying drawings. The scope of the foregoing should, therefore, be determined not with reference to the above description alone, but instead should be determined with reference to the appended claims along with their full scope of equivalents.

What is claimed is:

1. A weapon platform comprising:

a cradle having a shape and size to receive and secure a weapon;

a local operator sensor to sense when an operator is locally controlling the weapon mounted in the cradle, the local operator sensor not being part of a trigger mechanism to fire the weapon mounted in the cradle;

safety equipment to selectively lock a pointing direction of the weapon and secure the weapon from firing; and a controller to:

cause the weapon mounted in the cradle to selectively operate in different operating modes, and when the weapon is operating in an operating mode in which the weapon is aimed and fired by a local operator, in response to receiving an indication from the local operator sensor indicating that the local operator is not locally controlling the weapon mounted in the cradle, send one or more control signals to the safety equipment to lock the pointing direction of the weapon and secure the weapon from firing.

2. The weapon platform of claim 1, wherein the operating mode in which the weapon is aimed and fired by the local operator is a stabilized operating mode.

3. The weapon platform of claim 1, wherein the operating mode in which the weapon is aimed and fired by the local operator is a non-stabilized operating mode.

4. The weapon platform of claim 1, wherein the safety equipment comprises an electro-mechanical brake.

5. The weapon platform of claim 1, wherein the safety equipment comprises a gimbal having motors which, when active, control the pointing direction of the weapon mounted in the cradle.

6. The weapon platform of claim 5, wherein prior to sending the one or more control signals to the safety equipment to lock the pointing direction of the weapon and secure the weapon from firing, the controller causes the weapon to operate in an operating mode in which the weapon is remotely steered and fired.

7. The weapon platform of claim 6, wherein the controller sends, in response to receiving an indication from a remote operator sensor indicating that no operator is remotely controlling the weapon mounted in the cradle, one or more control signals to the gimbal to lock the pointing direction of the weapon.

8. The weapon platform of claim 1, wherein the local operator sensor is located on a local grip of the weapon mounted in the cradle and detects local application of physical force by the operator.

9. The weapon platform of claim 8, wherein the local operator sensor comprises a paddle to detect local application of force by the operator, the paddle built into a grip of the weapon mounted in the cradle.

10. The weapon platform of claim 1, wherein the controller, when the weapon is operating in an operating mode in which the pointing direction of the weapon is locked and the weapon is secured from firing, in response to receiving a signal from the local operator sensor indicating that a local operator is locally controlling the weapon mounted in the cradle, causes the weapon to operate in an operating mode in which the weapon is aimed and fired by the local operator.

11. The weapon platform of claim 1, wherein the controller, when the weapon is operating in an operating mode in which the pointing direction of the weapon is locked and the weapon is secured from firing, in response to receiving a signal from a remote operator sensor indicating that a remote operator is remotely controlling the weapon mounted in the cradle, causes the weapon to operate in an operating mode in which the weapon is remotely steered and fired.

12. The weapon platform of claim 1, further comprising:

a communications interface to communicate with a remote control station that remotely operates the weapon mounted in the cradle in an operating mode in which the weapon is remotely steered and fired.

13. The weapon platform of claim 12, wherein the communications interface is for wired communication with the remote control station.

14. The weapon platform of claim 12, wherein the communications interface is for wireless communication with the remote control station.

15. The weapon platform of claim 1, wherein the controller prevents simultaneous operation of the weapon mounted in the cradle in both an operating mode in which the weapon is remotely steered and fired and an operating mode in which the weapon is aimed and fired by a local operator.

16. The weapon platform of claim 1, wherein the controller causing the weapon to operate in a different operating mode does not require physical modification of the weapon platform by the local operator.

17. A method comprising:

sensing, with a local operator sensor of a weapon platform, when an operator is locally controlling a weapon mounted in a cradle of the weapon platform, the local operator sensor not being part of a trigger mechanism to fire the weapon mounted in the cradle;

causing the weapon mounted in the cradle to selectively operate in different operating modes; and when the weapon is operating in an operating mode in which the weapon is aimed and fired by a local operator, in response to receiving an indication from the local operator sensor indicating that the local operator is not locally controlling the weapon mounted in the cradle, locking the pointing direction of the weapon and securing the weapon from firing.

18. The method of claim 17, further comprising:

prior to locking the pointing direction of the weapon and securing the weapon from firing, causing the weapon to operate in an operating mode in which the weapon is remotely steered and fired.

19. The method of claim 18, further comprising:

in response to receiving an indication from a remote operator sensor indicating that no operator is remotely controlling the weapon mounted in the cradle, locking the pointing direction of the weapon.

20. The method of claim 17, further comprising:

when the weapon is operating in an operating mode in which the pointing direction of the weapon is locked and the weapon is secured from firing, in response to receiving a signal from the local operator sensor indicating that a local operator is locally controlling the weapon mounted in the cradle, causing the weapon to operate in an operating mode in which the weapon is aimed and fired by the local operator.

21. The method of claim 17, further comprising:

when the weapon is operating in an operating mode in which the pointing direction of the weapon is locked and the weapon is secured from firing, in response to receiving a signal from a remote operator sensor indicating that a remote operator is remotely controlling the weapon mounted in the cradle, causing the weapon to operate in an operating mode in which the weapon is remotely steered and fired.

* * * * *